US005304074A

United States Patent [19]

Andre et al.

[11] Patent Number: 5,304,074

[45] Date of Patent: Apr. 19, 1994

[54] MODULAR ELECTRICAL CONNECTOR

[75] Inventors: Marcel D. Andre, Vert Saint Denis; Christophe Bouchan, Longjumeau, both of France

[73] Assignee: Molex Incorporated, Lisle, Ill.

[21] Appl. No.: 56,106

[22] Filed: May 3, 1993

[30] Foreign Application Priority Data

Jun. 24, 1992 [EP] European Pat. Off. ..... 92110606.8

[51] Int. Cl.[5] ..... H01R 4/24

[52] U.S. Cl. ..... 439/417; 439/676

[58] Field of Search ..... 439/389–425, 439/676

[56] References Cited

U.S. PATENT DOCUMENTS

| | | | |
|---|---|---|---|
| 4,327,958 | 5/1982 | Hughes et al. | 339/276 |
| 4,413,872 | 11/1993 | Rudy, Jr. et al. | 439/410 |
| 4,426,125 | 1/1993 | Crawford | 439/409 |
| 4,820,192 | 4/1989 | Denkmann et al. | 439/404 |
| 4,865,564 | 9/1989 | Denkmann et al. | 439/404 |
| 4,975,078 | 12/1990 | Stroede et al. | 439/405 |
| 4,995,830 | 2/1991 | Eckhaus | 439/409 |

*Primary Examiner*—Joseph H. McGlynn
*Attorney, Agent, or Firm*—A. A. Tirva

[57] ABSTRACT

An electrical connector is disclosed in a modular telephone connector configuration and includes a housing defining a standard telephone jack. A plurality of stamped metal terminals each have a resilient cantilever jack contact portion, a wire insulation displacement portion and an intermediate portion between the cantilever jack contact portion and the wire insulation displacement portion. The housing is a one-piece structure overmolded about portions of the stamped metal terminals, with the wire insulation displacement portions exposed for receiving insulated telephone wires. The housing includes a cavity for receiving a standard telephone plug. The cantilever jack contact portions of the terminals are exposed by the overmolded housing adjacent the cavity, whereby the contact portions can be bent into the cavity. The housing includes at least one wire-driving portion molded integrally therewith by a living hinge and movable into engagement with the insulated telephone wires to drive the wires into the insulation displacement portions of the terminals.

19 Claims, 6 Drawing Sheets

MODULAR ELECTRICAL CONNECTOR

FIELD OF THE INVENTION

This invention generally relates to the art of electrical connector assemblies and, particularly, to a modular telephone connector, although various aspects of the invention are applicable to connectors, in general.

BACKGROUND OF THE INVENTION

A common type of female electrical connector or receptacle is referred to in the industry as a telephone jack or "modular jack". Such a modular telephone connector includes a dielectric housing defining a standard telephone receptacle jack. A plurality of terminals are mounted in the housing, and each terminal includes a resilient cantilever jack contact portion projecting into a plug-receiving cavity or opening in the housing for engaging contacts of a standard telephone plug. Most often, the terminals are stamped and formed of sheet metal material and include terminating portions, such as wire insulation displacement portions, opposite the resilient cantilever jack contact portions. The wire insulation displacement portions receive insulated telephone wires.

A wide variety of designs for modular telephone connectors have been proposed to facilitate field installation. Any design should maximize ease of manipulation of the telephone wires and ease of assembly and termination of the connector. Unfortunately, heretofore, even with all of the various design proposals, such modular jacks still employ too many components which are difficult to manipulate and assemble, particularly with the every-increasing miniaturization of such components. Problems still are encountered with various designs of field installable modular telephone connectors because of their size, the assembly manipulations required and the difficulty of terminating the telephone wires to the connector.

This invention is directed to solving these problems by providing a unique modular electrical connector, particularly adaptable as a modular telephone connector or jack, which includes a one-piece molded housing which has various integral, relatively movable portions for effecting complete assembly and termination of the connector without any extraneous components or tools.

SUMMARY OF THE INVENTION

An object, therefore, of the invention is to provide a new and improved modular electrical connector, in general, and to provide a unique modular telephone connector or jack, in particular.

In the exemplary embodiment of the invention, the modular telephone connector includes a housing defining a standard telephone jack. A plurality of stamped metal terminals are mounted in the housing, and each terminal has a resilient cantilever jack contact portion, a wire insulation displacement portion and an intermediate portion between the cantilever jack contact portion and the wire insulation displacement portion. The housing is provided in the form of a one-piece structure overmolded about the intermediate portions of the stamped metal terminals, with the wire insulation displacement portions of the terminals exposed for receiving insulated telephone wires. The housing includes a cavity or opening for receiving a standard telephone plug. The cantilever jack contact portions of the terminals are exposed adjacent the cavity, whereby the contact portions can be bent into the cavity for engaging contacts of the telephone plug upon insertion of the plug into the cavity.

A feature of the invention is directed to providing at least one wire-driving portion of the connector housing molded integrally therewith by a living hinge, whereby the wire-driving portion is movable into engagement with at least some of the insulated telephone wires to drive the wires into the insulation displacement portions of the terminals. As disclosed herein, the wire insulation displacement portions of the terminals project from opposite sides of the housing, and a pair of the wire-driving portions are molded integrally with opposite sides of the housing by a pair of living hinges.

Another feature of the invention involves forming the wire insulation displacement portions of the terminals with closed keyhole-shaped insulation displacement slots defining enlarged slot portions sized for receiving the insulated telephone wires, along with narrow slot portions communicating with the enlarged slot portions for piercing the insulation of the telephone wires. The wire-driving portions of the housing are effective to drive the telephone wires into the narrow slot portions of the keyhole-shaped slots.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
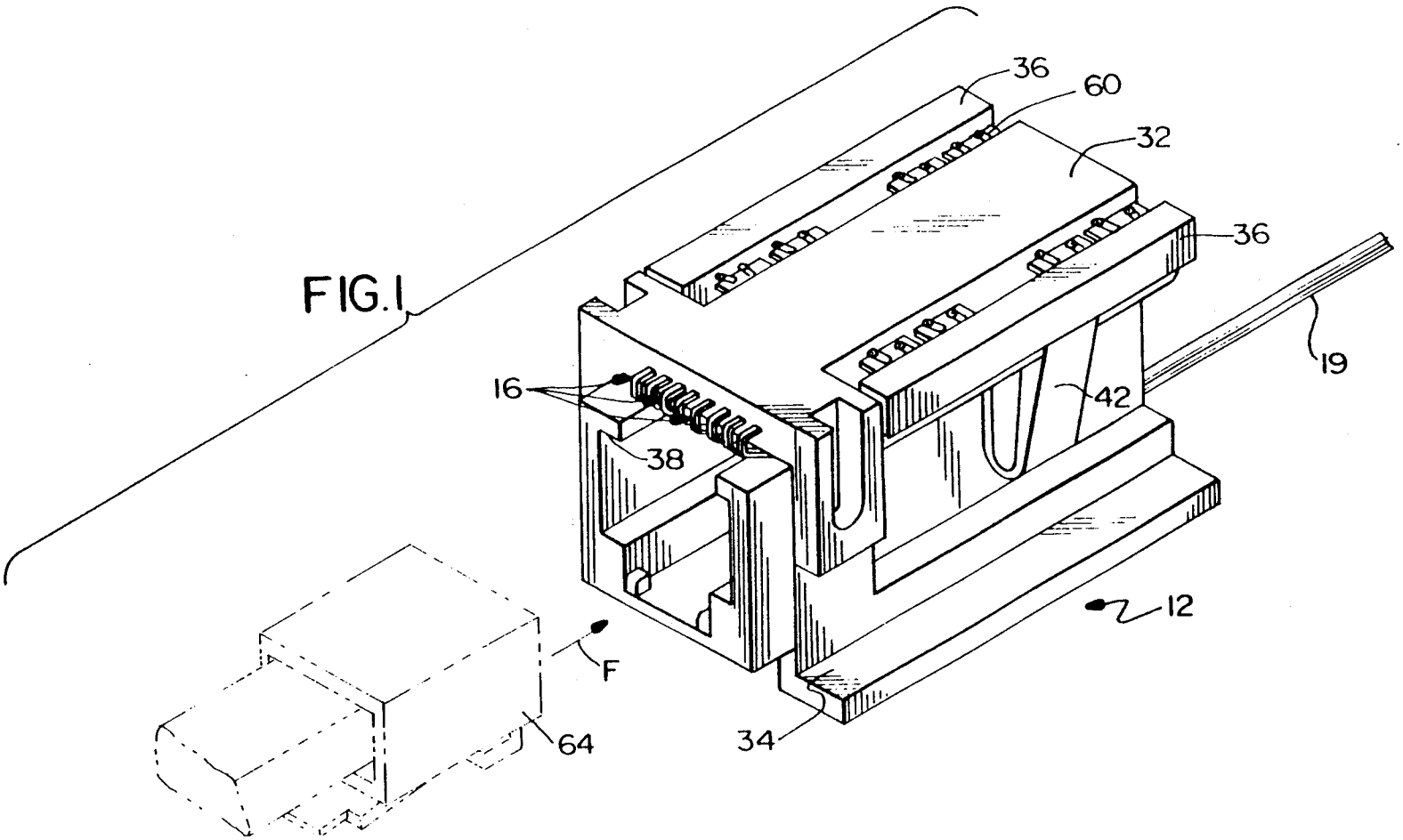
FIG. 1 is a perspective view of a fully assembled modular telephone jack incorporating the concepts of the invention.

Referring to the drawings in greater detail, and first to FIG. 1, the concepts of the invention are illustrated in a modular telephone connector or jack, generally designated 12, which includes a one-piece housing, generally designated 14 The housing is unitarily molded of dielectric material, such as plastic or the like, and will be described in greater detail hereinafter. Generally, a portion of the housing is overmolded about portions of a plurality of stamped metal terminals, generally designated 16, and the terminals are insulation-displacement-terminated to a plurality of telephone wires of a telephone cable 18, all of which will be described in greater detail hereinafter. At this point, it should be understood that, although the concepts of the invention are disclosed herein embodied in a modular telephone connector or jack, various aspects of the invention are equally applicable for other types of electrical connectors.

The following detailed description is being presented in a step-by-step fashion involving initial manufacturing steps, initial sub-assembly steps prior to providing or shipping the pre-assembled connector to a user, and finally the telephone wire termination steps carried out by the user. This approach is believed to be most advantageous in presenting various aspects of the invention in a precise and understandable description.

Figure 2:
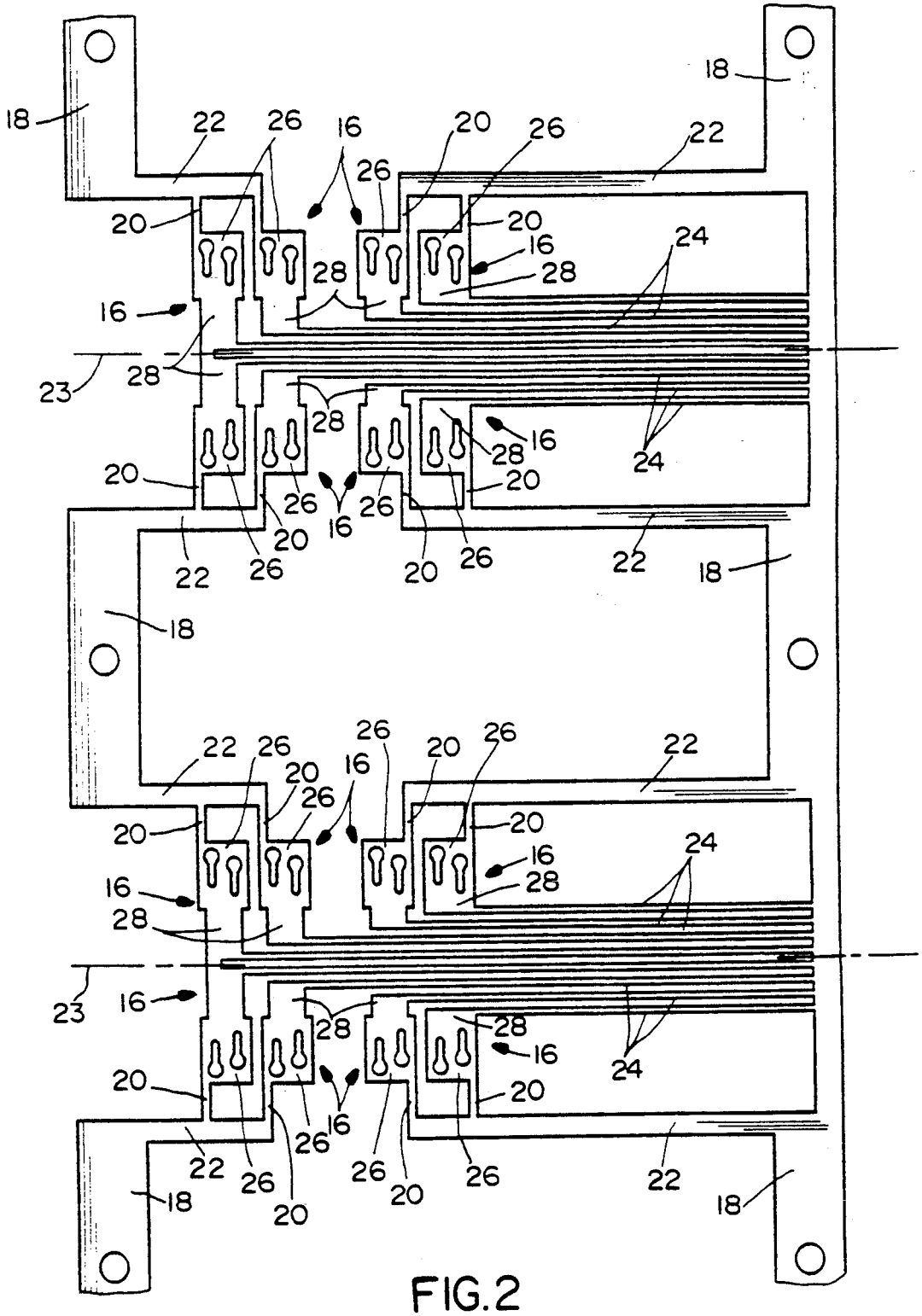
FIG. 2 is a plan view of a fragmented portion of a continuous metal strip from which the terminals of the connector are stamped, illustrating two sets of terminals for a pair of connectors.

More particularly, referring first to FIG. 2, terminals 16 first are stamped from a continuous strip of sheet metal material to a blank configuration including a pair of continuous carrier strips 18 which carry the terminals in stamped form through an appropriate stamping machine. Of course, the terminals are in a flat or planar configuration in the stamped blank of FIG. 2. It can be seen that the terminals are joined by web portions 20 and transverse webs 22 to carrier strips 18. It also can be seen that the terminals are stamped on opposite sides of a transverse center line 23, with four terminals on each side of the center line for a total "terminal cluster" of eight terminals for each telephone connector 12 (FIG. 1).

Each stamped metal terminal 16 includes a resilient cantilever jack contact portion 24, a wire insulation displacement portion 26 and an intermediate portion 28, although the right-hand terminals shown in FIG. 2 have no distinct intermediate portion except integral areas of wire insulation displacement portions 26. Eventually, cantilever jack contact portions 24 of the terminals will be severed from the right-hand carrier strip 18 and bent into the connector housing 14, as will be described in greater detail hereinafter.

Figure 3:
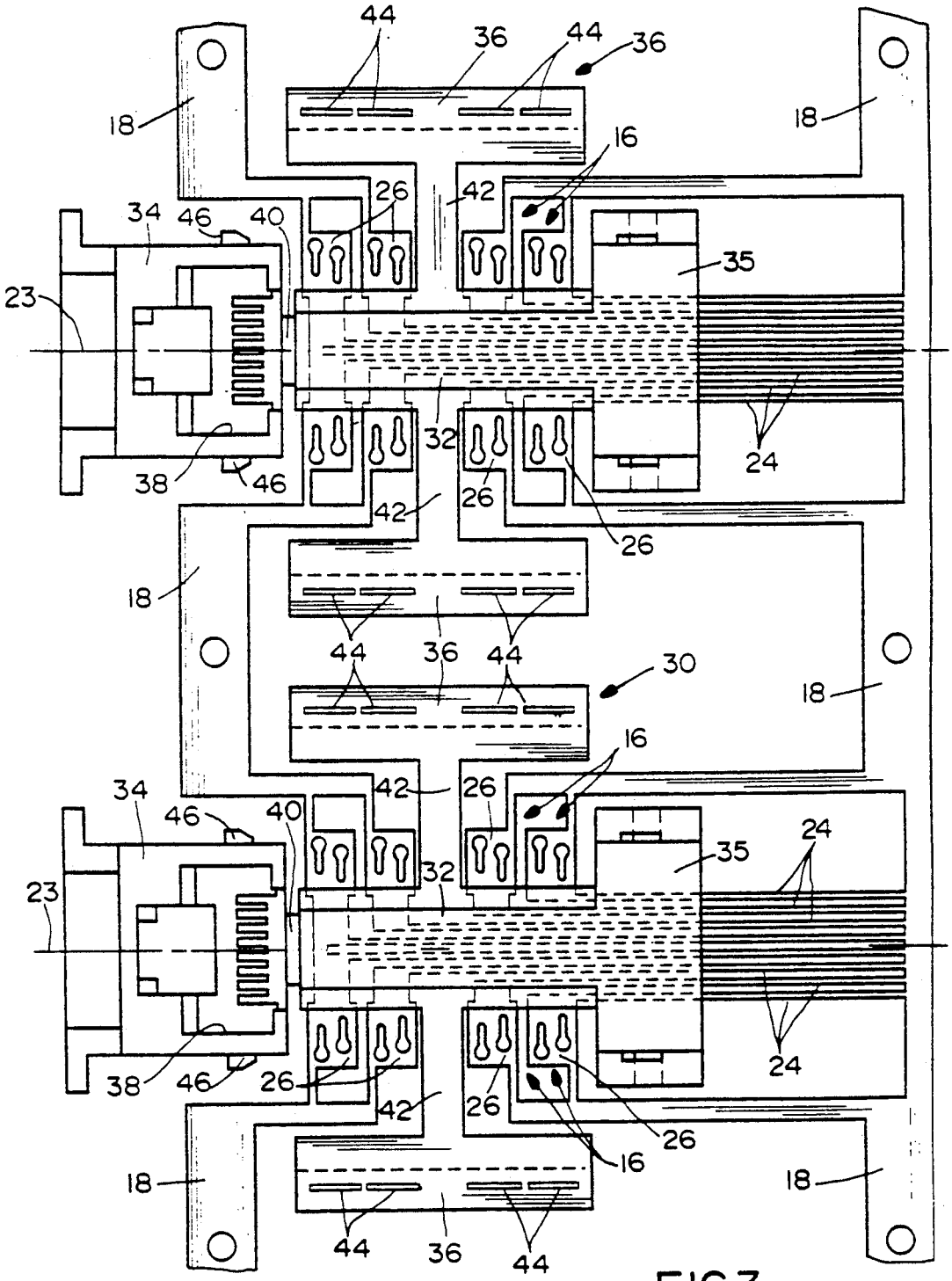
FIG. 3 is a view similar to that of FIG. 2, illustrating a pair of one-piece housing structures overmolded about intermediate portions of the terminals.
Figure 4:
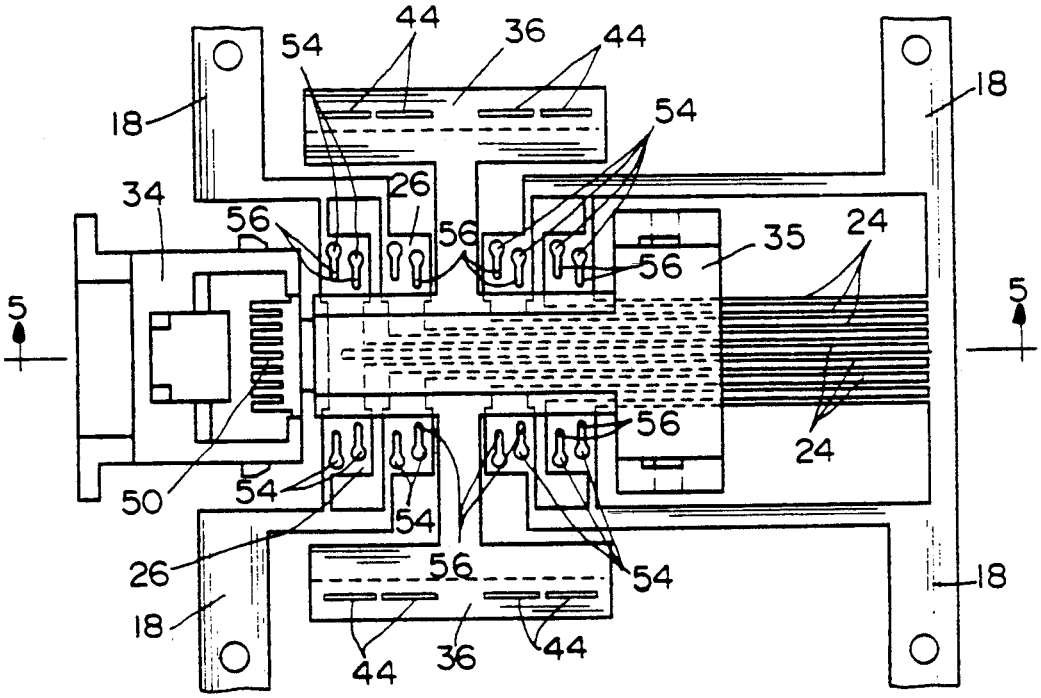
FIG. 4 is a view of only one of the overmolded housing structures and a single set of terminals, as depicted in FIG. 3.
Figure 5:
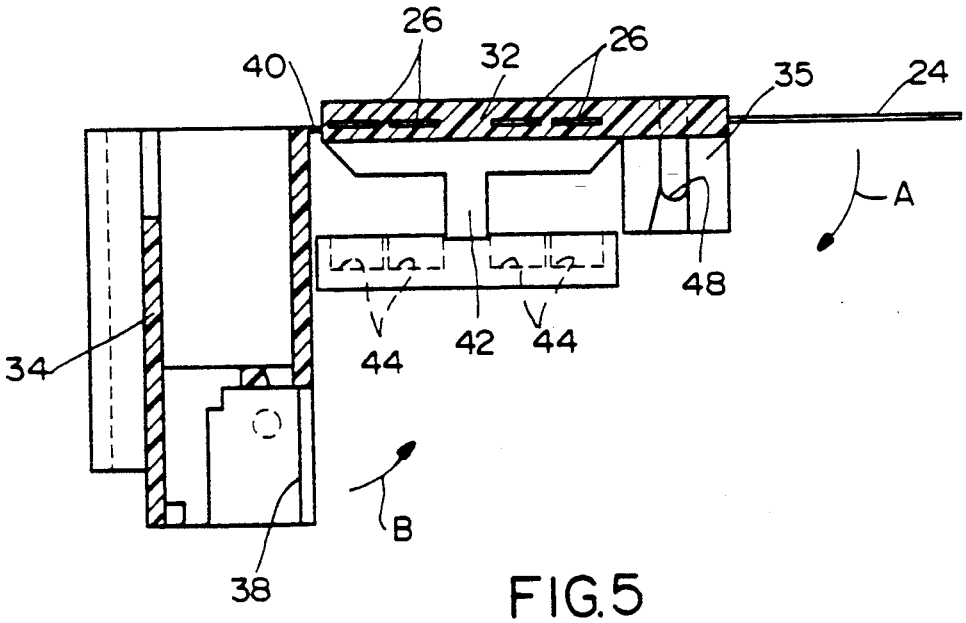
FIG. 5 is a horizontal section taken generally along line 5—5 of FIG. 4.

The next step in fabricating modular telephone connector 12 is shown in FIGS. 3-5 and, generally, involves overmolding a one-piece housing subassembly structure about portions of terminals 16, generally about the intermediate portions of at least some of the terminals. More particularly, an overmolded housing structure or subassembly, generally designated 30, includes a top or center overmolded portion 32, a main housing portion 34, a latch portion 35 and a pair of wire-driving portions 36. It can be seen that the top or center overmolded portion 32 is molded about portions of terminals 16 such that wire insulation displacement portions 26 of the terminals are exposed exteriorly on opposite sides of the center overmolded portion of the housing subassembly structure. It also can be seen that latch portion 35 is overmolded about inner areas of cantilever jack contact portions 24, leaving considerable areas of the contact portions exposed for bending purposes, as described hereinafter.

Main housing portion 34 includes an opening or cavity 38 which is provided for receiving a standard telephone plug, as will be more apparent hereinafter. The main housing portion is molded integral with top or center overmolded portion 32 by a living hinge 40. Each wire-driving portion 36 also is molded integral with top or center overmolded portion 32 by a living hinge 42. Each wire-driving portion also includes slots or grooves 44 in the top thereof for effecting insulation displacement termination of telephone wires to the wire insulation displacement portions 26 of terminals 16, again as will be described in greater detail hereinafter.

Lastly, at this point, in order to better understand the following detailed description, it should be noted in FIG. 5 that main housing portion 34 and wire-driving portions 36 depend downwardly from top or center overmolded portion 32 of the housing. Living hinges 40 and 42 also are clearly visible in this figure. After housing subassembly structure 30 (FIGS. 3 and 4) is overmolded about portions of terminals 16, as described above, webs 20 (FIG. 2) then are severed from wire insulation displacement portions 26 of the terminals, and cantilever jack contact portions 24 are severed from the right-hand carrier strip 18 of the stamped metal blank described above in relation to FIG. 2. The cantilever jack contact portions now are rendered flexible or resilient because of their becoming free from the carrier strip.

Figure 6:
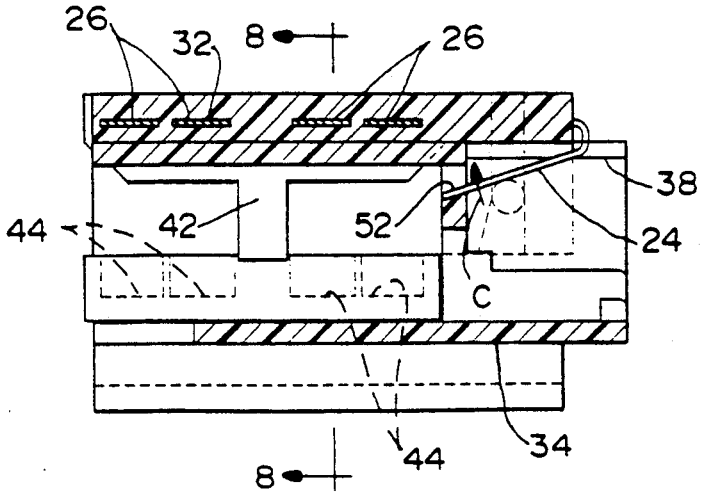
FIG. 6 is a sectional view similar to that of FIG. 5, during a step of manufacture wherein the cantilever jack contact portions of the terminals have been bent into the housing cavity, and the base portion of the housing structure has been pivoted to a latched condition, versus the initial overmolded condition shown in FIG. 5.
Figure 7:
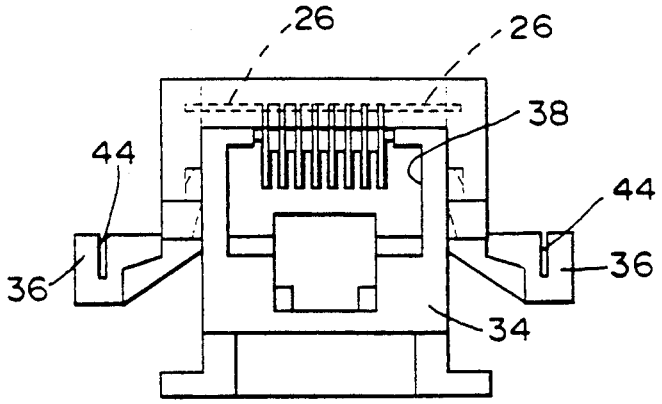
FIG. 7 is a front elevational view, looking toward the right-hand end of FIG. 6, with the wire-driving portions of the housing structure in inoperative positions.

After all of the extraneous webs and carrier strips have been removed from the stamped metal blank, cantilever jack contact portions 24 then are formed or bent, and overmolded housing subassembly 30 is assembled into a subassembly for shipping to and/or use by an ultimate user. Of course, the entire modular telephone connector 12 can be fully assembled in a manufacturing environment, if such an application is desirable. In either event, reference is made to FIGS. 6 and 7, particularly in conjunction with FIG. 5. Cantilever jack contact portions 24 first are bent downwardly in the direction of arrow "A" (FIG. 5) to the configuration shown in FIG. 6, whereby the contact portions now are disposed within cavity or opening 38. Main housing portion 34 then is pivoted about living hinge 40 in the direction of arrow "B" (FIG. 5). As seen in FIG. 7, the main housing portion will move upwardly between the side wire-driving portions 36. When the main housing portion is moved to its fully assembled position as shown in FIG. 6, the main housing portion is latched in that position by a pair of latch bosses 46 (FIG. 3) snapping into a pair of latch grooves 48 (FIG. 5) on the inside of latch portion 35 of the overmolded housing structure. When in the assembled condition, cantilever jack contact portions are disposed within a comb structure 50 (FIG. 4) and seat on top of ledges 52 (FIG. 6) of the comb structure. When a standard telephone plug is inserted into opening 38, the resilient cantilever jack contact portions engage contacts on the plug as the jack contact portions are biased upwardly in the direction of arrow "C" (FIG. 6).

Wire-driving portions 36 of overmolded housing structure 30 are used to drive insulated wires of telephone cable 18 (FIG. 1) into insulation displacement condition with wire insulation displacement portions 26 of terminals 16. Before proceeding, however, reference is made back to FIGS. 2–4 where it can be seen that each wire insulation displacement portion 26 of each terminal 16 includes a pair of keyhole-shaped slots, each slot including an enlarged slot portion 54 communicating with a narrow slot portion 56. The enlarged slot portions 54 are sized sufficiently larger than the insulated wires of the telephone cable so that the wires can be inserted easily into the enlarged slot portions. The narrow slot portions 56 are sufficiently narrow to cut through or pierce the insulation of the telephone wires to establish conductivity with the cores of the wires.

Figure 8:
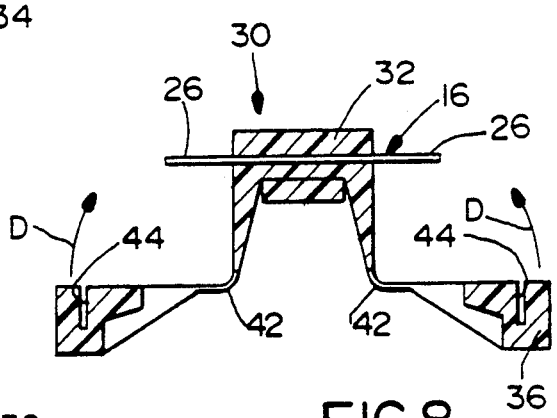
FIG. 8 is a vertical section taken generally along line 8—8 of FIG. 6, again showing the wire-driving portions of the housing structure in inoperative positions, as depicted in FIG. 7.
Figure 9:
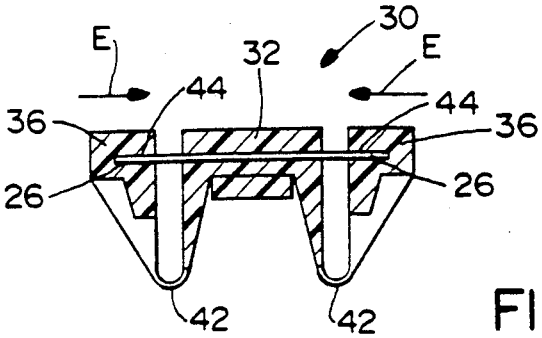
FIG. 9 is a view similar to that of FIG. 8, with the wire-driving portions pivoted to their wire terminating positions.

With the above understanding, and with reference to FIGS. 8 and 9, it can be seen in FIG. 8 that wire-driving portions 36 project outwardly of the center or top portion 32 of the overmolded housing structure 30, with the wire-driving portions being interconnected to the center portion by living hinges 42. Therefore, the wire-driving portions can be pivoted upwardly in the direction of arrows "D" (FIG. 8). It also should be noted that slots 44 in the wire-driving portions have widths which are at least slightly larger than the thickness of the metal material from which insulation displacement portions 26 of terminals 16 are fabricated. Therefore, wire-driving portions 36 can be pivoted upwardly in the direction of arrows "D", about living hinges 42, whereupon wire insulation displacement portions 26 of the terminals enter into slots 44 as shown in FIG. 9. Since the enlarged slot portions 54 are disposed transversely outwardly relative to narrow slot portions 56, as seen clearly in FIG. 4, if insulated wires are located in the enlarged slot portions, wire-driving portions 36 will drive the wires into the narrow slot portions 56, as indicated by arrows "E" in FIG. 9. Therefore, wire-driving portions 36 of the overmolded housing structure are effective to terminate the telephone wires to the terminals. Slots 44 in the wire-driving portions should be of widths to establish an interference fit with insulation displacement portions 26 of the terminals, so that the wire-driving portions remain in their terminating positions as shown in FIG. 9.

Figure 10:
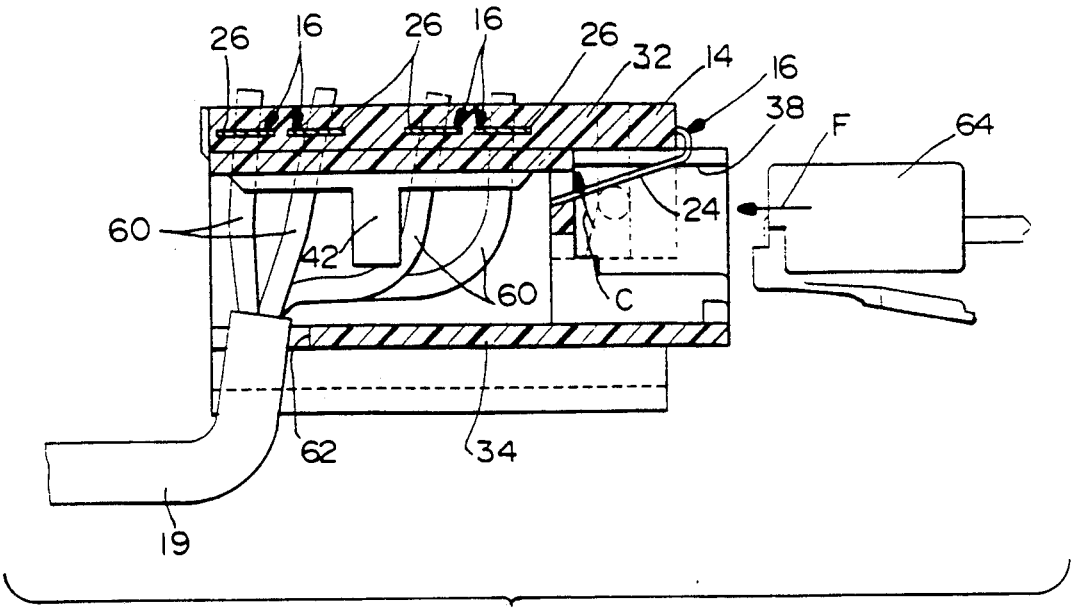
FIG. 10 is a vertical section through the fully assembled and terminated modular connector, as taken generally along line 10—10 of FIG. 1, in conjunction with a standard telephone plug.

FIG. 10 shows modular telephone connector 12 fully terminated to a plurality of insulated wires 60 of telephone cable 18. This depiction corresponds to the "subassembly" illustration of FIGS. 6 and 7, except that the insulated wires 60 are shown terminated to insulation displacement portions 26 of terminals 16, as described above in relation to FIGS. 8 and 9. It can be seen that telephone cable 18 can be inserted through a recessed area 62 of main housing portion 34, and insulated wires 60 simply are fed upwardly through enlarged slot portions 54 (FIG. 4), whereupon wire-driving portions 36 of the overmolded housing structure can be used to drive the insulated wires into the narrow slot portions 56, as described above. The modular telephone connector now is fully assembled and ready to receive a standard telephone plug 64 insertable into opening 38 in the direction of arrow "F", as shown in FIG. 10.

Figure 11:
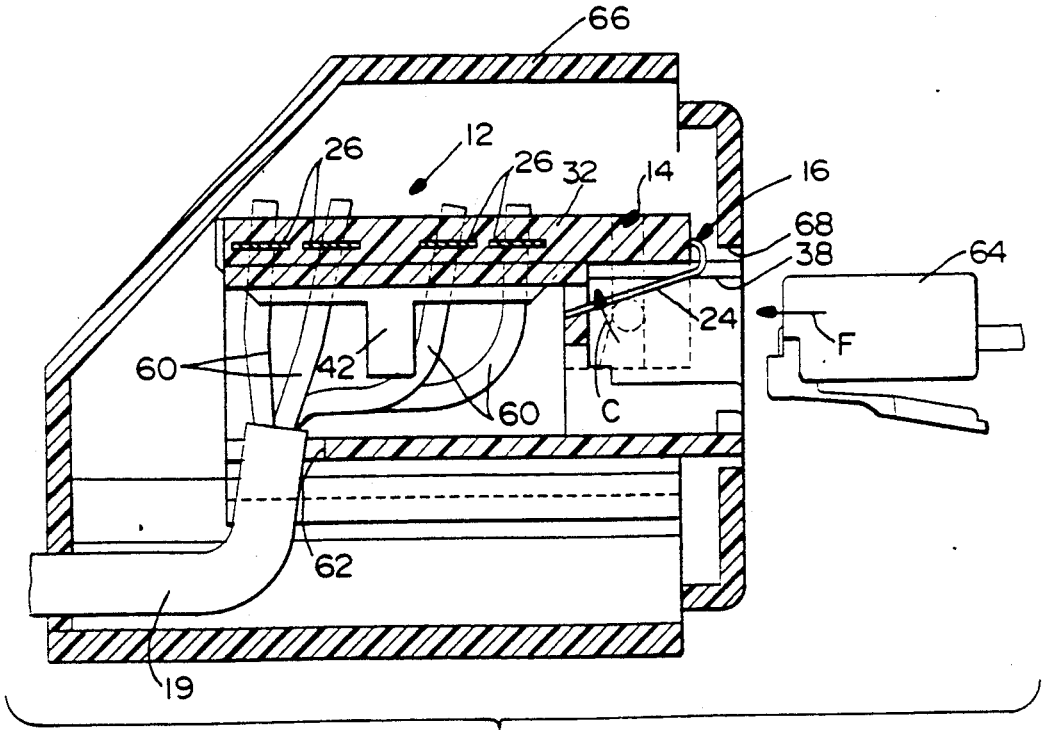
FIG. 11 is a view similar to that of FIG. 10, showing the connector mounted within a particular housing environment.

Lastly, FIG. 11 illustrates an application of using modular telephone connector 12 within a particular housing 66 which includes a front aperture 68 through which telephone plug 64 can be inserted into opening 38 in the modular telephone connector. Appropriate contacts on the plug (not shown) will engage resilient cantilever jack contact portions 24 and bias the contact portions upwardly in the direction of arrow "C".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a modular telephone connector which includes a housing defining a standard telephone jack, and a plurality of stamped metal terminals each having a resilient cantilever jack contact portion and a wire insulation displacement portion, wherein the improvement comprises said housing being a one-piece structure overmolded about portions of the stamped metal terminals with the wire insulation displacement portions thereof exposed for receiving insulated telephone wires, the housing including a cavity for receiving a standard telephone plug, and the cantilever jack contact portions of the terminals being exposed by the overmolded housing adjacent the cavity whereby the contact portions can be bent into the cavity.

2. In a modular telephone connector as set forth in claim 1, wherein said wire insulation displacement portions of the terminals include closed keyhole-shaped insulation displacement slots defining enlarged slot portions sized for receiving the insulated telephone wires, and narrow slot portions communicating with the enlarged slot portions for piercing the insulation of the telephone wires when the wires are moved from the enlarged slot portions with the narrow slot portions.

3. In a modular telephone connector as set forth in claim 2, wherein said housing includes at least one wire-driving portion molded integrally therewith and movable into engagement with at least some of the insulated telephone wires to drive the wires into the narrow slot portions of at least some of the insulation displacement slots.

4. In a modular telephone connector as set forth in claim 3, including a living hinge portion integrally connecting the wire-driving portion to afford driving movement thereof.

5. In a modular telephone connector as set forth in claim 4, wherein the wire insulation displacement portions of some of the terminals project from opposite sides of the housing, and including a pair of said wire-driving portions integrally connected on opposite sides of the housing.

6. In a modular telephone connector as set forth in claim wherein said housing includes at least one wire-driving portion molded integrally therewith and movable into engagement with at least some of the insulated telephone wires to drive the wires into insulation-piercing condition with at least some of the insulation displacement portions of the terminals.

7. In a modular telephone connector as set forth in claim 6, including a living hinge portion integrally connecting the wire-driving portion to afford driving movement thereof.

8. In a modular telephone connector as set forth in claim 7, wherein the wire insulation displacement portions of some of the terminals project from opposite sides of the housing, and including a pair of said wire-driving portions integrally connected on opposite sides of the housing.

9. In a modular telephone connector as set forth in claim 1, wherein said one-piece housing structure includes a center portion overmolded about portions of the stamped metal terminals, a main housing portion at one end of the center portion defining said cavity and molded integrally with the center portion and movable into an assembled condition, a latch portion at an opposite end of the center portion for latching engagement with the main housing portion, and at least one wire-driving portion molded integrally with the center portion and movable into engagement with at least some of the insulated telephone wires to drive the wires into the insulation displacement portions of the terminals.

10. In a modular telephone connector as set forth in claim 9, including a living hinge portion integrally molded between the main housing portion and the center portion of the housing to afford movement therebetween.

11. In a modular telephone connector as set forth in claim 9, including a living hinge portion integrally molded between the center portion and the wire-driving portion to afford driving movement thereof.

12. In a modular telephone connector as set forth in claim 11, the wire insulation displacement portions of the terminals project from opposite sides of the center portion of the housing, and including a pair of said wire-driving portions molded integrally with the center portion on opposite sides thereof.

13. A method of fabricating and assembling a modular telephone connector, comprising the steps of:

stamping a plurality of terminals from sheet metal material, each terminal having a resilient cantilever jack contact portion and a wire insulation displacement portion;

overmolding a one-piece housing structure about areas of the terminals, the housing structure being molded with a center portion overmolded about said areas of the terminals, exposing said cantilever jack contact portions and said wire insulation displacement portions, a main housing portion molded by a living hinge integral with the center portion and defining a cavity for receiving a standard telephone plug, and at least one wire-driving portion molded integrally with the center portion by a living hinge;

moving said main housing portion about its living hinge into juxtaposition with the center portion of the housing;

inserting a plurality of insulated telephone wires into the insulation displacement portions of the terminals; and moving the wire-driving portion of the housing about its living hinge into engagement with the insulated telephone wires to drive the wires into the insulation displacement portions of the terminals.

14. The method of claim 13, including the step of stamping the insulation displacement portions of the terminals with closed keyhole-shaped insulation displacement slots having enlarged slot portions sized for receiving the insulated telephone wires and narrow slot portions communicating with the enlarged slot portions for piercing the insulation of the telephone wires, whereby said wire-driving portion of the housing is effective to move the insulated telephone wires from the enlarged slot portions into the narrow slot portions of the closed key-hole-shaped slots.

15. In a modular electrical connector which includes a housing, and a plurality of terminals mounted in the housing and having exposed wire insulation displacement portions, wherein the improvement comprises said housing being a one-piece molded structure including an integral wire-driving portion movable into engagement with a plurality of insulated wires to drive the wires into the insulation displacement portions of the terminals.

16. In a modular electrical connector as set forth in claim 15, wherein said wire insulation displacement portions of the terminals include closed keyhole-shaped insulation displacement slots defining enlarged slot portions sized for receiving the insulated wires, and narrow slot portions communicating with the enlarged slot portions for piercing the insulation of the wires when the from the enlarged slot portions with the narrow slot portions.

17. In a modular electrical connector as set forth in claim 15, including a living hinge portion integrally connecting the wire-driving portion to afford driving movement thereof.

18. In a modular electrical connector as set forth in claim 17, wherein the wire insulation displacement portions of some of the terminals project from opposite sides of the housing, and including a pair of said wire-driving portions integrally connected on opposite sides of the housing.

19. In a modular telephone connector which includes a housing defining a standard telephone jack, and a plurality of stamped metal terminals each having a resilient cantilever jack contact portion and a wire insulation displacement portion, wherein the improvement comprises said wire insulation displacement portions of the terminals including closed keyhole-shaped insulation displacement slots defining enlarged slot portions sized for receiving the insulated telephone wires and narrow slot portions communicating with the enlarged slot portions for piercing the insulation of the telephone wires when the wires are moved from the enlarged slot portions into the narrow slot portions.

* * * * *